United States Patent [19]

Matsuyama et al.

[11] 4,040,839

[45] Aug. 9, 1977

[54] DIRECT-POSITIVE PROCESS UTILIZING A SUPERSENSITIZED SILVER HALIDE EMULSION

[75] Inventors: Junichi Matsuyama; Masanao Hinata; Akira Sato, all of Minami-ashigara, Japan

[73] Assignee: Fuji Photo Film Co., Ltd., Minami-ashigara, Japan

[21] Appl. No.: 687,819

[22] Filed: May 19, 1976

[30] Foreign Application Priority Data

May 19, 1975 Japan ..... 50-59479

[51] Int. Cl.[2] ..... G03C 5/24; G03C 1/28

[52] U.S. Cl. ..... 96/64; 96/124; 96/95; 96/77; 96/100

[58] Field of Search ..... 96/64, 124

[56] References Cited

U.S. PATENT DOCUMENTS

| | | | |
|---|---|---|---|
| 2,497,875 | 2/1950 | Fallesen | 96/64 |
| 3,206,313 | 9/1965 | Porter et al. | 96/68 |
| 3,628,964 | 12/1971 | Shiba et al. | 96/124 |
| 3,761,266 | 9/1973 | Milton | 96/64 |
| 3,761,267 | 9/1973 | Gilman et al. | 96/64 |
| 3,873,324 | 3/1975 | Hinata et al. | 96/124 |

*Primary Examiner*—Won H. Louie, Jr.
*Attorney, Agent, or Firm*—Sughrue, Rothwell, Mion, Zinn and Macpeak

[57] ABSTRACT

A silver halide photographic emulsion containing at least one sensitizing dye of the following general formula (I) and at least one sensitizing dye of general formulae (II) and/or (III), in an amount effective to achieve supersensitization:

(I)

wherein $V^1$ and $V^2$, which may be the same or different, each represents a hydrogen atom, halogen atom, trifluoromethyl, cyano, carboxy, alkoxycarbonyl, aminosulfonyl or alkylsulfonyl; $W^1$ and $W^2$, which may be the same or different, each represents a hydrogen atom, halogen atom, alkyl, alkoxy, hydroxy, acyloxy or phenyl; $R^1$ represents alkyl or substituted alkyl; $R^2$ and $R^3$, which may be the same or different, each represents alkyl or substituted alkyl, and at least one of $R^2$ and $R^3$ represents 1 or 0; substituted alkyl containing a carboxy or sulfo radical; $R^4$ and $R^5$, which may be the same or different, each has the same meanings as $R^1$; $X^-$ represents an acid anion; and *m* represents 1 or 0;

(II)

wherein $V^3$ and $V^4$, which may be the same or different, each has the same meaning as $V^1$ and $V^2$; $W^3$ and $W^4$, which may be the same or different, each has the same meaning as $W^1$ and $W^2$; $R^6$ has the same meaning as $R^1$; $R^7$ and $R^8$, which may be the same or different, each has the same meaning as $R^2$ and $R^3$; $X^-$ represents an acid anion; and *n* represents 1 or 0;

(III)

wherein $W^5$ and $W^6$, which may be the same or different, each has the same meaning as $W^3$ and $W^4$; $R^{10}$ and $R^{11}$, which may be the same or different, each has the same meaning as $R^2$ and $R^3$; $R^9$ represents an alkyl group; $X^-$ represents an acid anion; and *p* represents 1 or 0.

8 Claims, No Drawings

DIRECT-POSITIVE PROCESS UTILIZING A SUPERSENSITIZED SILVER HALIDE EMULSION

BACKGROUND OF THE INVENTION

1. Field of the Invention

The present invention relates to a spectrally sensitized silver halide photographic emulsion, particularly, it relates to a spectrally sensitized silver halide photographic emulsion which is useful in methods of obtaining direct positive images by the surface development treatment of an internal latent image silver halide photographic emulsion in the presence of a fogging agent.

2. Description of the Prior Art

Methods of obtaining a direct positive image by the surface development treatment of an internal latent image silver halide photographic emulsion in the presence of a fogging agent, and photographic emulsions or sensitive materials used in such methods, are known and are described in U.S. Pat. Nos. 2,456,953, 2,497,875, 2,497,876, 2,588,982, 2,675,318, 3,227,552, British Pat. No. 1,151,363, Japanese Patent Publication No. 29,405/68, U.S. Pat. No. 2,592,250, British Pat. No. 1,011,062, and so on.

An internal latent image silver halide photographic emulsion can be defined as one which contains sensitive centers mostly in the interior of the silver halide grains and which forms a latent image mostly in the interior of the silver halide grains resulting from such internal sensitive centers. A photographic emulsion comprising such silver halide grains cannot substantially be developed with a surface developer, that is, a developer which develops only a latent image on the surface of the silver halide grains.

In the above methods of obtaining a direct positive image, a fogging agent can be added to the developer, but better reversal characteristics are obtained if the fogging agent is adsorbed on the surface of the silver halide grains by incorporating it in a photographic emulsion layer or another layer of the sensitive material.

In a silver halide photographic material, a silver halide photographic emulsion is, in most cases, spectrally sensitized. Particularly, in color photographic materials a green sensitive layer and a red sensitive layer as well as a blue sensitive layer are essential, and spectral sensitization is required in order to obtain a green sensitive and a red sensitive layer. In photograhic materials for obtaining a direct positive images, competitive adsorption between a fogging agent and a spectral sensitizing dye occurs and spectral sensitization is inhibited when a fogging agent is incorporated into the photograhic material. One method of solving such difficulty is described in U.S. Pat. No. 3,718,470, i.e., using a spectral sensitizing dye containing in its molecule a substituent having fogging activity. However, the method of imparting fogging activity and spectral sensitivity to one molecule has the defects that the use of an amount thereof sufficient for spectral sensitization is unsuitable fo nucleating (fogging) or the use of an amount thereof sufficient for nucleating is unsuitable for the spectral sensitization. We have found a more improved method of obtaining the color sensitization reversal characteristics than the above known method.

SUMMARY OF THE INVENTION

One object of the present invention resides in the improvement of the spectral sensitization of silver halide photographic emulsions used in methods of obtaining direct positive images by a surface developing of an internal latent image type silver halide photographic emulsions containing a fogging agent, i.e., an object of the present invention is to obtain high spectral sensitivity in the spectral region of sensitivity, preferably, in the spectral region of green sensitivity.

Another object of the present invention is to obtain a direct positive image having high maximum density and low minimum density in a method of obtaining a direct positive image by developing in a surface developer an internal latent image type silver halide photographic emulsion in the presence of a fogging agent.

Another object of the present invention is to accomplish the above two objects at the same time.

According to the present invention, a fogging agent can be incorporated in a silver halide emulsion in an amount sufficient to give satisfactory image characteristics (maximum density, minimum density and the like) for direct positive images, so that the desired spectral sensitivity can be imparted to the silver halide emulsion without reducing the effect of the fogging agent.

Further, the effect of the present invention becomes remarkable when a development inhibitor such as, for example, a benzotriazole is added to the internal latent image emulsion, as is described in U.S. Pat. No. 2,497,917.

According to the present invention, excellent spectral sensitization and high maximum density and sufficiently low minimum density of the direct positive image can be obtained even when an internal latent image type silver halide emulsion not containing the fogging agent is surface developed in the presence of the fogging agent to form the direction positive image.

The above objects of the present invention are attained by spectrally supersensitizing the silver halide emulsion layer with a combination of at least one sensitizing dye of the following general formula (I) and at least one sensitizing dye of the following general formulae (II) or (III) (which includes also the combination of (I) plus (II) plus (III)), in obtaining direct positive images by developing a photographic material containing an internal lagent image silver halide emulsion layer having a fogging agent, with a surface developer:

(I)

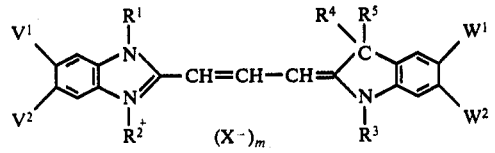

(II)

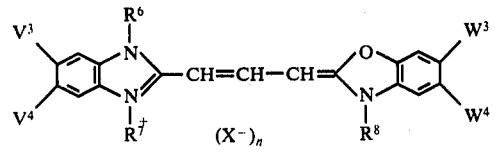

(III)

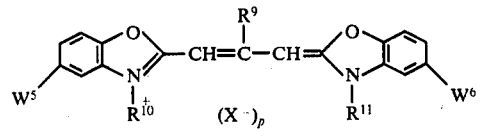

In the above general formulae, $V^1$ and $V^2$ may be the same or different, and each represents hydrogen atom, a halogen atom (fluorine atom, chlorine atom, bromine atom or iodine atom), a trifluoromethyl group, a cyano group, a carboxy group, an alkoxycarboxyl group having at most 6 carbon atoms (e.g., methoxycarbonyl, ethoxycarbonyl and the like), an aminosulfonyl group (e.g., unsubstituted aminosulfonyl, methylaminosulfonyl, dimethylaminosulfonyl, diethylaminosulfonyl, morpholinosulfonyl, piperidinosulfonyl and the like), or an alkylsulfonyl group having at most 6 carbon atoms (e.g., methylsulfonyl).

$V^3$ and $V^4$ have the same meanings as $V^1$ and $V^2$.

$W^1$ and $W^2$ may be the same or different and each represents a hydrogen atom, a halogen atom (fluorine atom, chlorine atom, bromine atom or iodine atom), an alkyl group having at most 6 carbon atoms (e.g., methyl, ethyl, isopropyl, n-butyl and the like), an alkoxy group having at most 6 carbon atoms (e.g., methoxy, ethoxy, butoxy and the like), a hydroxy group, an aliphatic acyloxy group having at most 6 carbon atoms (e.g., acetoxy) or a phenyl group (which may be unsubstituted or may be substituted by methyl, a chlorine atom(s) and the like).

$W^3$ and $W^4$ may be the same or different and have the same meanings as $W^1$ and $W^2$.

$W^5$ and $W^6$ have the same meanings as $W^3$ and $W^4$. $R^1$ represents an alkyl group having at most 6 carbon atoms (e.g., methyl, ethyl, isopropyl, n-butyl and the like), or a substituted alkyl group containing as a substituent: a hydroxy group, an alkylcarbonyloxy group having at most 6 carbon atoms, an alkoxy group having at most 6 carbon atoms, an alkoxycarbonyl group having at most 6 carbon atoms, a carboxy group, a sulfo group, a vinyl group, a cyano group, a carbamoyl group, a sulfoalkoxy group having at most 6 carbon atoms, a sulfoalkoxyalkoxy group having at most 6 carbon atoms, a carboxyalkoxy group having at most 6 carbon atoms, and the like.

Examples of these substituted alkyls are a β-hydroxyethyl, β-acetoxyethyl, γ-acetoxypropyl, β-methoxyethyl, γ-methoxypropyl, β-methoxycarbonylethyl, γ-methoxycarbonylpropyl, δ-ethoxycarbonylbutyl, carboxymethyl, β-carboxyethyl, γ-carboxypropyl, γ-carboxybutyl, β-sulfoethyl, γ-sulfopropyl, γ-sulfobutyl, δ-sulfobutyl, allyl, β-cyanoethyl, β-carbamoylethyl, 2-(3-sulfopropoxy)ethyl, 2-[2-(3-sulfopropoxyethoxy)]-ethyl, 2-(2-carboxyethoxy)ethyl and the like on the alkyl moiety thereof.

$R^2$ and $R^3$ may be the same or different and have the same meanings as $R^1$, but at least one of $R^2$ and $R^3$ is a substituted alkyl group containing a carboxy group, or a substituted alkyl group containing a sulfo group.

$R^7$ and $R^8$ have the same meanings as $R^2$ and $R^3$.

$R^{10}$ and $R^{11}$ have the same meanings as $R^2$ and $R^3$.

$R^4$ and $R^5$ may be the same or different and have the same meanings as $R^1$.

$R^6$ has the same meaning as $R^1$.

When $R^2$, $R^3$, $R^7$, $R^8$, $R^{10}$, $R^{11}$, $R^4$, $R^5$ or $R^6$ represent a substituted alkyl group, examples of substituents and substituted alkyl groups are the same as given for $R^1$.

$R^9$ represents an alkyl group having at most 4 carbon atoms (e.g., methyl, ethyl, n-propyl and the like).

X− represents an anion (e.g., chloride, bromide, iodide, methylsulfate, ethylsulfate, p-toluene sulfonate).

*m, n* and *p* represent 1 or 0. When the dye molecule forms an inner salt, *m, n* or *p* represent 0.

In the above general formulae, as preferred substituents at least one of $V^1$ and $V^2$ and at least one of $V^3$ and $V^4$ are halogen atoms, particularly chlorine atoms (the other(s), if any are not chlorine, being hydrogen atoms); $W^1$ and $W^2$ are hydrogen atoms, an alkyl group, particularly methyl, or an alkoxy group, particularly methoxy; $W^3$, $W^4$, $W^5$ and $W^6$ are hydrogen atoms, halogen atoms, particularly chlorine atoms, a phenyl group or an alkoxy group, particularly methoxy; $R^1$ and $R^6$ are an alkyl group, particularly methyl or ethyl, a hydroxyalkyl group, particularly β-hydroxyethyl, an alkylcarbonyloxyalkyl group, particularly β-acetoxyethyl; $R^2$, $R^3$, $R^7$, $R^8$, $R^{10}$ and $R^{11}$ are an unsubstituted alkyl group, a hydroxyalkyl group, particularly β-hydroxyethyl, a carboxyalkyl group, particularly carboxymethyl or β-carboxyethyl, or a sulfoalkyl group, particularly β-sulfoethyl, γ-sulfopropyl, γ-sulfobutyl or δ-sulfobutyl; $R^4$ and $R^5$ are an unsubstituted alkyl group, particularly methyl; and $R^9$ is an ethyl group.

Examples of the dyes used in the present invention are shown below, but the present invention is not limited to these examples.

Dyes of general formula (I)

I-A

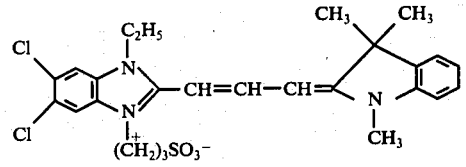

I-B

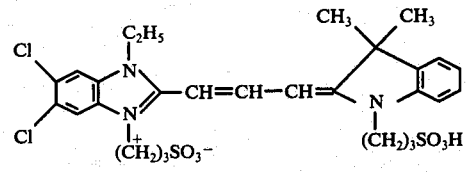

I-C

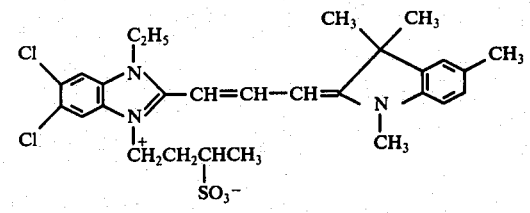

I-D

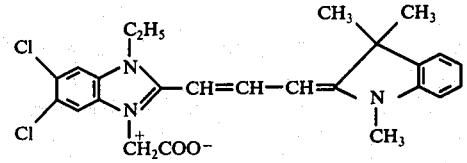

I-E

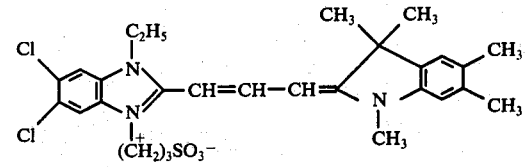

I-F

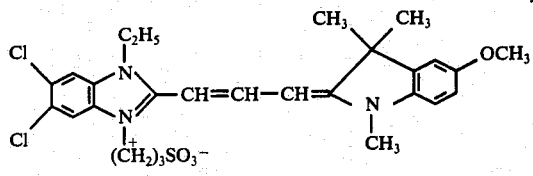

I-G

-continued
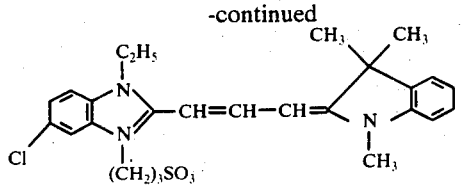
I-H
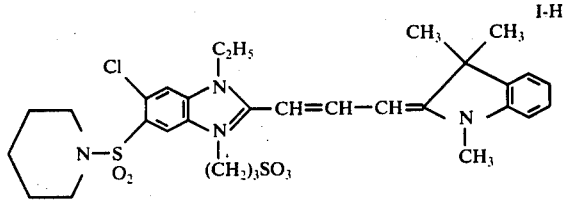
Dyes of general formula (II)
II-A
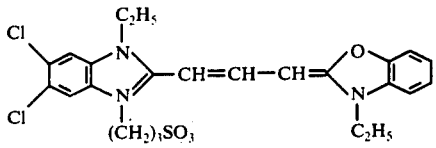
II-B
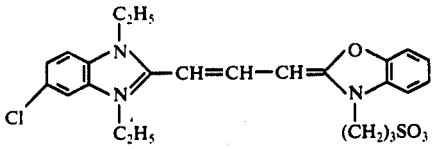
II-C
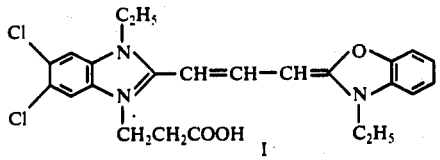
II-D
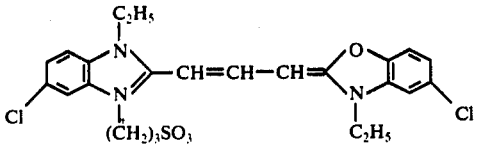
II-E
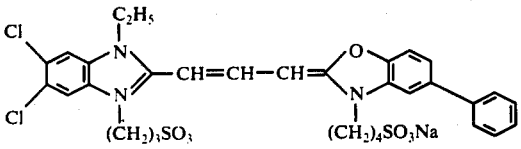
II-F
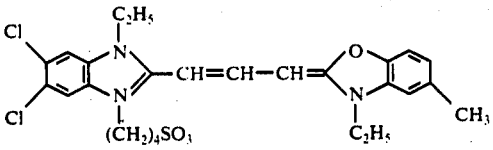
II-G
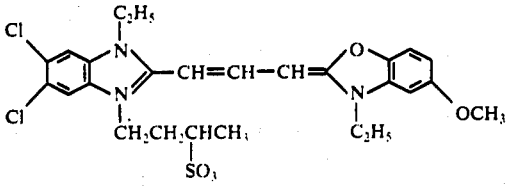
Dyes of general formula (III)
III-A
-continued
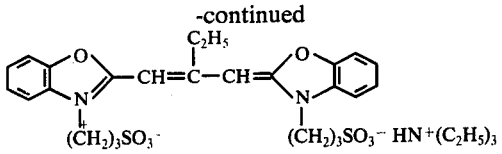
III-B
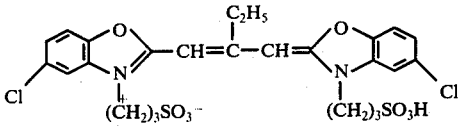
III-C
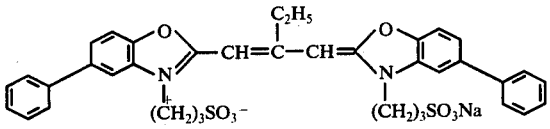
III-D
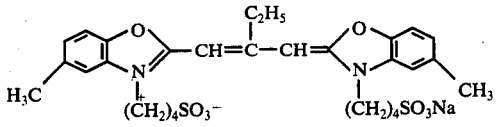
III-E
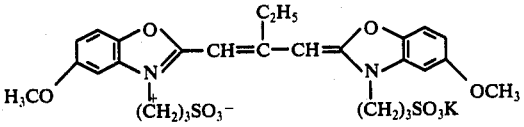
III-F
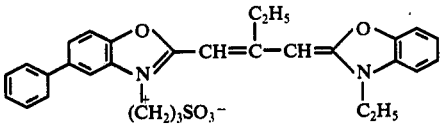
III-G
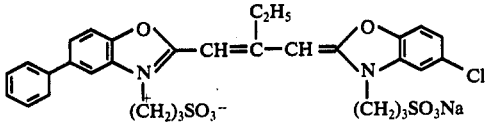
III-H
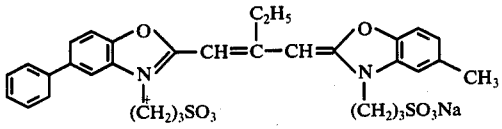
III-I
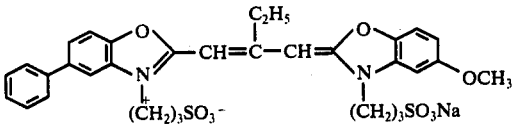
III-J
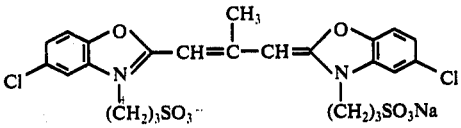
III-K
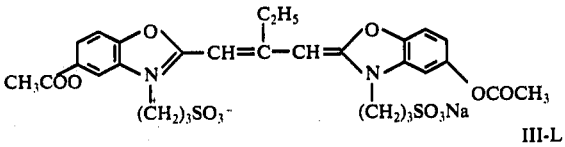
III-L -continued

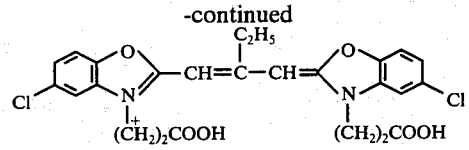

An internal latent image emulsion is a silver halide emulsion which forms latent images primarily in the interior of the silver halide grains, and is distinguished from silver halide grains which form a latent image primarily on the surfaces of the grains. Such internal latent image emulsions are described in U.S. Pat. No. 2,592,250 Davey and other literature. Internal latent image silver halide emulsions can be defined more definitely by the fact that an internal latent image silver halide emulsion, when developed in an "internal" developer, exhibits a maximum density higher than that obtained when developed in a "surface" developer. Internal latent image emulsions suitable for use in the present invention can be ascertained as follows: when a transparent support coated with the silver halide emulsion is exposed for a fixed time between 0.01 and 1 second and then developed for 3 minutes at 20° C in the following developer A (internal developer), it exhibits a maximum density (measured by a conventional photographic density mesuring method) at least 5 times that of the maximum density obtained when the same silver halide emulsion is exposed in the same way and developed in the following developer B (surface developer) for 4 minutes at 20° C.

Preferably, the maximum density obtained with developer A is at least 10 times the maximum density obtained with developer B. As internal latent image emulsions suitable for the objects of the present invention, especially valuable are those described in British Pat. No. 1,027,146, U.S. Pat. Nos. 3,206,313, 3,511,662, 3,447,927, 3,737,313, 3,271,157 and the like, as well as those described in the aforementioned U.S. Pat. No. 2,592,250, but the emulsions used in the invention are not limited to these emulsions.

| | |
|---|---|
| Developer A | |
| Hydroquinone | 15 g |
| Monomethyl-p-aminophenol sesquisulfate | 15 g |
| Sodium sulfite | 50 g |
| Potassium bromide | 10 g |
| Sodium hydroxide | 25 g |
| Sodium thiosulfate | 20 g |
| Water to make | 1 l |
| Developer B | |
| p-oxyphenylglycine | 10 g |
| Sodium carbonate | 100 g |
| Water to make | 1 l |

The present invention is useful for the spectral sensitization of internal latent image type silver halide emulsions used in a photographic method of obtaining direct positive images by surface developing the image-wise exposed silver halide emulsion in the presence of a fogging agent. In the preferred method of the invention, the unexposed grains are surface fogged by surface developing the layer in the presence of a fogging agent.

The term surface developer as used herein has its normal meaning, namely a developer which will develop a surface latent image but will not develop to any substantial extent an internal latent image. A surface developer can include any conventional silver halide developing agents but should be substantially free of any silver halide solvent (such as ammonium or a water soluble thiocyanate or thiosulfates) which will dissolve or crack the grain to reveal the internal latent image specks. A small amount of excess halide is sometimes desirable, and can be provided in the developer, or incorporated in the emulsion, by a halide releasing compound, but a larger amount is generally to be avoided in order to prevent substantial cracking of the grain, especially in the case where an iodide releasing compound is employed.

Silver halide developing agents which can be used in a surface developing composition include polyhydroxybenzenes such as hydroquinone, catechols, aminophenols, 3-pyrazolidones, ascorbic acid and derivatives thereof, reductones, and phenylenediamines or combinations thereof.

The present invention is particularly useful when the fogging agent (nucleating agent) or fog center forming agent is incorporated in the internal latent image silver halide emulsion. A suitable fogging agent is one that is effective in development or in a pre-bath to selectively cause silver halide grains not containing internal images (that is, internal development centers) to form surface development centers, thereby rendering the grains developable with a surface developer, but which does not cause silver halide grains containing internal images (internal development centers) to newly form surface development centers.

The fogging agents used in the present invention include hydrazines as described in U.S. Pat. Nos. 2,588,982 and 2,568,785, hydrazides and hydrazones as described in U.S. Pat. 3,227,552 and hydrazone quaternary salts as described in U.S. Pat. No. 3,615,615. Preferred fogging agents are hydrazines or hydrazone quaternary salts.

The amount of the fogging agent used in the present invention can be varied widely depending on the desired results. When added to the photographic material, the concentration of the fogging agent is generally about 50 to about 1,500 mg/l mol Ag, preferably 300 to 600 mg/l mol Ag. When added to a developer, the amount of the fogging agent is about 0.05 to about 5 g, preferably 0.1 to 1 g, per liter of the developer. Incorporating the fogging agent into any layer of the photographic material is effective to render the fogging agent non-diffusible. When added to a pre-bath, the amount of the fogging agent is about 0.05 to about 5 g, preferably 0.1 to 1 g, per liter of the pre-bath.

The silver halide emulsion of the present invention can contain a color image forming coupler, or the emulsion can be developed in a developer containing a color image forming coupler. Any known method can be used to add the color former to the silver halide emulsion of the present invention. For example, there can be used the methods described in U.S. Pat. Nos. 1,055,155, 1,102,028, 2,186,849, 2,322,027 and 2,801,171. In the present invention developing agents such as polyhydroxybenzenes, aminophenols and 3-pyrazolidones can be incorporated in at least one photosensitive emulsion layer or other water permeable layers of the photographic material. In the present invention the photographic emulsion can be unhardened, if desired, and tanning developing agents such as hydroquinone and catechol can be incorporated therein, if desired.

The photographic emulsion of the present invention can also be used in combination with a dye image providing material for diffusion transfer, which releases a diffusable dye in correspondence to developed silver halide, to obtain a desired transferred image on an image receiving material after appropriate development. As such color image affording substance for diffusion transfer, many compounds are known, and are described in U.S. Pat. Nos. 3,227,551, 3,237,554, 3,443,939, 3,443,940, 3,658,524, 3,698,897, 3,725,062, 3,728,113, 3,751,406, British Pat. Nos. 840,731, 904,364, 1,038,331, German Patent Publications (OLS) Nos. 1,930,215, 2,214,381, 2,228,361, 2,242,762, 2,317,134, 2,402,900, 2,406,626, 2,406,653, Japanese Patent Application (OPI) NO. 114,424/74, etc.

Various colloids can be used as vehicles or binders in the direct positive photographic material of the present invention.

Suitable colloids used for such purpose include any hydrophilic colloids generally used in the photograhic field, for example, gelatin, colloidal albumin, polysaccharides, cellulose derivatives, e.g., hydroxyethyl cellulose, and synthetic resins (e.g., polyvinyl compounds including polyvinyl alcohol derivatives, e.g., poly(-vinylpyrrolidone) acrylamide polymers, polyvinyl alcohol polymers, and acrylamide polymers). The vehicle or binder can have added thereto a hydrophobic colloid such as a dispersed polymerized vinyl compound, particularly one that increases the dimensional stability of the photographic material, in combination with the hydrophilic colloid, if desired. Suitable compounds of this kind are water insoluble polymers such as alkyl acrylates, alkyl methacrylates, acrylic acid, sulfoalkyl acrylates, sulfoalkyl methacrylates and the like.

Photographic elements can be prepared by coating the photographic compositions of the present invention on various supports. The silver halide emulsion can be coated on either one side or on both sides of a support, which is preferably transparent or flexible. Representative supports include cellulose nitrate film, cellulose ester films, polyvinyl acetal film, polystryene film, polyethylene terephthalate film, other polyester films, glass, paper, metal, and wood. A support such as paper coated with an α-olefin polymer, particularly a polymer of an α-olefin containing two or more carbon atoms, for example, polyethylene, polypropylene or an ethylene-butene copolymer, gives good results.

The photographic silver halide emulsion layer and other layers present in the photographic elements prepared in accordance with the present invention can be hardened by optional suitable hardeners. Such hardeners include aldehyde hardeners such as formaldehyde and mucochloric acid, aziridine hardeners, dioxane derivatives, oxypolysaccharides such as dialdehyde starch, oxyguargum and the like.

The photographic silver halide emulsion can contain other additives, if desired, particularly those which are known as useful for photographic emulsions, for example, lubricants, stabilizers, speed increasing agents, light absorbing dyes, plasticizers and the like.

Further, the silver halide emulsion can contain an iodine ion releasing compound (e.g., potassium iodide), and a desired image can be obtained using a developer containing iodine ions.

It is sometimes advantageous to use surface active agents or mixtures thereof in the preparation of the photographic material of the present invention. Suitable materials of this kind include nonionic, cationic and ampholytic surface active agents, such as polyoxyalkylene derivatives, amphoteric amino acid dispersing agents (including sulfobetaines) and the like. Such surface active agents are shown in U.S. Pat. Nos. 2,600,831, 2,271,622, 2,271,623, 2,275,727, 2,787,604, 2,816,920 and 2,739,891 and in Belgian Pat. No. 652,862.

The sensitizing dyes used in the present invention are used in a concentration equal to that as is used with conventional negative silver halide emulsions. It is particularly advantageous to use the dyes in such a concentration that they do not substantially cause an inherent desensitization of the silver halide emulsion. It is preferred to use each dye in an amount of from about $1.0 \times 10^{-5}$ to about $5 \times 10^{-4}$ mol of the sensitizing dye per gram mol of silver halide, particularly about $4 \times 10^{-5}$ to about $2 \times 10^{-4}$ mol of the sensitizing dye per gram mol of silver halide.

The optimum concentration of the sensitizing dyes can be determined in accordance with known methods, e.g., by dividing the emulsion into several parts, incorporating the sensitizing dyes into each part in different concentrations and then measuring the respective spectral sensitivity.

The addition of the sensitizing dyes into the emulsion is conducted in a conventional manner, e.g., the sensitizing dyes can be dispersed directly into the emulsion, or, alternatively, the sensitizing dyes can be added to the emulsion in the form of a solution, prepared by dissolving the sensitizing dyes in a water miscible solvent such as pyridine, methanol, ethanol, methyl cellosolve or acetone, or a mixture thereof, and, if desired, diluting the thus prepared solution with water; or prepared by dissolving the sensitizing dyes only in water. In addition, ultrasonic vibrations can be used to assist the dissolution. In addition, there can be used the methods described in Japanese Patent Publications Nos. 8,231/70, 23,389/69, 27,555,/69, 22,948/69, German Patent Publication (OLS) No. 1,947,935, U.S. Pat. Nos. 3,485,634, 3,342,605, 2,912,343, etc.

If desired, the sensitizing dyes can be dissolved in suitable solvents and then each solution solvent added separately to the emulsion. Alternatively, the sensitizing dyes can be dissolved in the same or different solvents, and then the thus prepared solutions mixed before addition to the silver halide emulsion.

One feature of the present invention resides in the fact that high maximum density and low minimum density can be obtained by a combination of the sensitizing dyes of the present invention when surface developed in the presence of a fogging agent.

Another feature of the present invention is that high green sensitivity can be obtained by a combination of the sensitizing dyes of the present invention when the silver halide emulsion contains a fogging agent. In such a case, high sensitivity to green light as in the case with the present invention could not be obtained following the prior art even if combinations of known sensitizing dyes or sensitizing dyes affording supersensitization were used.

The present invention will now be illustrated in more detail by the following examples.

EXAMPLE 1

An internal latent image emulsion was prepared by the halogen conversion method described in U.S. Pat. No. 2,592,250.

| Solution 1 (prepared at 40° C) | |
|---|---|
| Inert gelatin | 20 g |
| Potassium chloride | 20 g |
| Water | 560 cc |
| Solution 2 (prepared at 45° C) | |

-continued

| | |
|---|---|
| Potassium chloride | 100 g |
| Water | 520 cc |
| Solution 3 (prepared at 45° C) | |
| Silver nitrate | 195 g |
| Water | 520 cc |
| Solution 4 (prepared at 45° C) | |
| Potassium bromide | 160 g |
| Potassium iodide | 40 g |
| Water | 500 cc |

Solutions 2 and 3 were added to solution 1 at the same time over 90 seconds, and, after ripening for 1 minute at 45° C, solution 4 was added. The obtained solution was ripened for 20 minutes at 45° C. Then, 235 g of inert gelatin (dry) was added, the solution ripened for 15 minutes at 45° C, and cooled and permitted to set to a film jelly, then the soluble salts removed by washing with water. Finally, 150 cc of a 10 wt% aqueous solution of potassium chloride was added, and the total volume was made 3½ liters by the addition of water.

The dyes in Tables 1 to 6 were then added to the thus prepared emulsion in the amounts given in Tables 1 to 6 per kg of the emulsion. The obtained silver halide emulsion was coated on a cellulose triacetate base (amount of silver coated: 200 $\mu$ g/cm$^2$), the elements image-wise exposed and then developed for 4 minutes at 20° C in the following developer to compare the characteristics thereof. The results are given in Tables 1 to 6.

In Tables 1 to 6, the reversal sensitivity is expressed as the relative value of the reciprocal of the exposure amount which gives a density of ½ the sum of (the maximum transmission density and the minimum transmission density).

| Developer | |
|---|---|
| N-methyl-p-aminophenol sesquisulfate | 2.5 g |
| Potassium bromide | 1.0 g |
| Ascorbic acid | 10.0 g |
| Sodium metaborate | 35.0 g |
| p-Tolylhydrazine hydrochloride | 0.3 g |
| pH adjusted to 11.5 | |
| Water to make the total volume 1 liter | |

In Tables 1 to 6 the dye addition amount is expressed as the number of mols of dye per kg of the emulsion.

TABLE 1

| No. | Dye | Addition Amount | Dye | Addition Amount | Reversal Sensitivity | Maximum Density | Minimum Density |
|---|---|---|---|---|---|---|---|
| 1 | I-D | $2\times10^{-4}$ | — | — | 100 | 2.3 | 0.09 |
| 2 | II-E | $4\times10^{-4}$ | — | — | 79 | 2.3 | 0.08 |
| 3 | I-D | $1\times10^{-4}$ | II-E | $2\times10^{-4}$ | 182 | 2.4 | 0.07 |
| 4 | CF-1 | $1\times10^{-4}$ | II-E | $2\times10^{-4}$ | 77 | 2.0 | 0.10 |

TABLE 2

| No. | Dye | Addition Amount | Dye | Addition Amount | Reversal Sensitivity | Maximum Density | Minimum Density |
|---|---|---|---|---|---|---|---|
| 5 | I-E | $2\times10^{-4}$ | — | — | 100 | 2.3 | 0.09 |
| 6 | II-C | $4\times10^{-4}$ | — | — | 87 | 2.3 | 0.09 |
| 7 | I-E | $1\times10^{-4}$ | II-C | $2\times10^{-4}$ | 200 | 2.4 | 0.08 |
| 8 | CF-3 | $1\times10^{-4}$ | II-C | $2\times10^{-4}$ | 83 | 2.1 | 0.10 |

TABLE 3

| No. | Dye | Addition Amount | Dye | Addition Amount | Reversal Sensitivity | Maximum Density | Minimum Density |
|---|---|---|---|---|---|---|---|
| 9 | I-H | $2\times10^{-4}$ | — | — | 100 | 2.2 | 0.08 |
| 10 | II-F | $4\times10^{-4}$ | — | — | 78 | 2.2 | 0.08 |
| 11 | I-H | $1\times10^{-4}$ | II-F | $2\times10^{-4}$ | 191 | 2.2 | 0.06 |
| 12 | CF-2 | $1\times10^{-4}$ | II-F | $2\times10^{-4}$ | 85 | 2.2 | 0.09 |

TABLE 4

| No. | Dye | Addition Amount | Dye | Addition Amount | Reversal Sensitivity | Maximum Density | Minimum Density |
|---|---|---|---|---|---|---|---|
| 13 | I-B | $2\times10^{-4}$ | — | — | 100 | 2.4 | 0.09 |
| 14 | III-B | $8\times10^{-4}$ | — | — | 93 | 2.2 | 0.08 |
| 15 | I-B | $1\times10^{-4}$ | III-B | $4\times10^{-4}$ | 224 | 2.4 | 0.07 |
| 16 | I-B | $1\times10^{-4}$ | CF-4 | $4\times10^{-4}$ | 98 | 2.4 | 0.10 |

TABLE 5

| No. | Dye | Addition Amount | Dye | Addition Amount | Reversal Sensitivity | Maximum Density | Minimum Density |
|---|---|---|---|---|---|---|---|
| 17 | I-H | $2\times10^{-4}$ | — | — | 100 | 2.2 | 0.08 |
| 18 | III-D | $4\times10^{-4}$ | — | — | 91 | 2.2 | 0.08 |
| 19 | I-H | $1\times10^{-4}$ | III-D | $2\times10^{-4}$ | 209 | 2.2 | 0.07 |
| 20 | I-H | $1\times10^{-4}$ | CF-5 | $2\times10^{-4}$ | 98 | 2.2 | 0.09 |

TABLE 6

| No. | Dye | Addition Amount | Dye | Addition Amount | Reversal Sensitivity | Maximum Density | Minimum Density |
|---|---|---|---|---|---|---|---|
| 21 | I-E | $2\times10^{-4}$ | — | — | 100 | 2.3 | 0.09 |
| 22 | III-C | $2\times10^{-4}$ | — | — | 98 | 2.3 | 0.10 |
| 23 | I-E | $1\times10^{-4}$ | III-C | $1\times10^{-4}$ | 204 | 2.3 | 0.08 |
| 24 | CF-3 | $1\times10^{-4}$ | III-C | $1\times10^{-4}$ | 100 | 2.3 | 0.10 |

The formulae of the dyes used for comparison in the Example are shown below.

CF-1

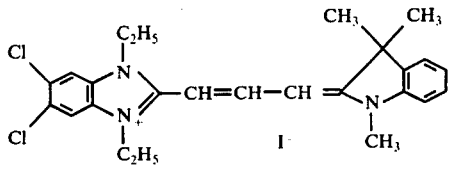

CF-2

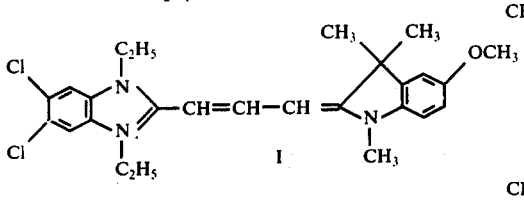

CF-3

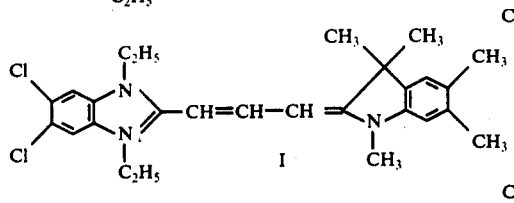

CF-4

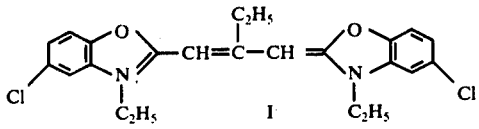

CF-5

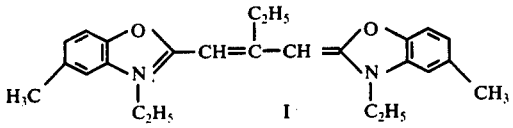

While the invention has been described in detail and with reference to specific embodiments thereof, it will be apparent to one skilled in the art that various changes and modifications can be made therein without departing from the spirit and scope thereof.

What is claimed is:

1. A method of obtaining a direct positive image, which comprises image-wise exposing a layer of an internal latent image silver halide emulsion, and then surface developing in contact with a fogging agent, wherein the internal latent image silver halide photographic emulsion yields a direct positive image on surface development in contact with said fogging agent and contains at least one sensitizing dye of the following general formula (I) and at least one sensitizing dye of the following general formula (II) and/or (III), in an amount effective to achieve supersensitization:

(I)

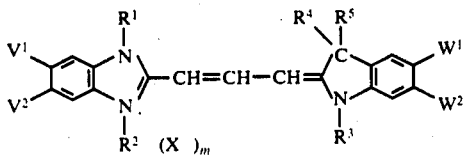

wherein $V^1$ and $V^2$ each represents a hydrogen atom, halogen atom, trifluoromethyl, cyano, carboxy, alkoxycarbonyl, aminosulfonyl or alkylsulfonyl; $W^1$ and $W^2$ each represents a hydrogen atom, halogen atom, alkyl, alkoxy, hydroxy, acyloxy or phenyl; $R^1$ represents alkyl or substituted alkyl; $R^2$ and $R^3$ each represents alkyl or substituted alkyl, and at least one of $R^2$ and $R^3$ represents substituted alkyl containing a carboxy or sulfo radical; $R^4$ and $R^5$ each has the same meaning as $R^1$; X− represents an acid anion; and *m* represents 1 or 0;

(II)

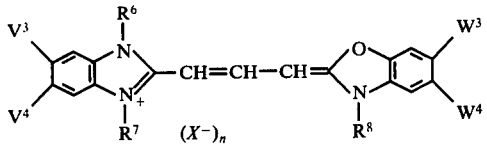

wherein $V^3$ and $V^4$ each has the same meaning as $V^1$ and $V^2$; $W^3$ and $W^4$ each has the meaning as $W^1$ and $W^2$; $R^6$ has the same meaning as $R^1$; $R^7$ and $R^8$ each has the same meaning as $R^2$ and $R^3$; X− represents an acid anion; and *n* represents 1 or 0;

(III)

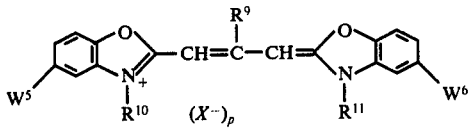

wherein $W^5$ and $W^6$ each has the same meaning as $W^3$ and $W^4$; $R^{10}$ and $R^{11}$ each has the same meaning as $R^2$ and $R^3$; $R^9$ represents an alkyl group; X− represents an acid anion; and *p* represents 0 or 1.

2. A method according to claim 1, wherein the fogging agent is selected from the group consisting of hyrazines, hydrazones, quaternary salt of hydrazones and aldehydes.

3. A method according to claim 1, wherein at least one of $V^1$ and $V^2$ in general formula (I) is a halogen atom and the other is a hydrogen atom, $W^1$ and $W^2$ are hydrogen atoms, alkyl or alkoxy, $R^4$ and $R^5$ are alkyl, $R^1$ is alkyl, hydroxyalkyl or alkylcarbonyloxy; in general formula (II) at least one of $V^3$ and $V^4$ is a halogen atom and the other is a hydrogen atom, $W^3$ and $W^4$ are hydrogen atoms, halogen atoms, phenyl or alkoxy, $R^6$ is alkyl, hydroxyalkyl or alkylcarbonyloxy; and in general formula (III) $W^5$ and $W^6$ are hydrogen atoms, halogen atoms, phenyl or alkoxy, and $R^9$ is ethyl.

4. The method according to claim 3, wherein at least one of respective $R^2$ and $R^3$, $R^7$ and $R^8$ and $R^{10}$ and $R^{11}$ is carboxyalkyl or sulfoalkyl.

5. The method according to claim 3, wherein at least one of respective $V^1$ and $V^2$, and $V^3$ and $V^4$ is a chlorine atom and the other is a hydrogen atom.

6. The method according to claim 5, wherein $W^1$ and $W^2$ are hydrogen atoms, methyl or methoxy, $R^4$ and $R^5$ are methyl, $R^1$ and $R^6$ are methyl, ethyl, β-hydroxyethyl or β-acetoxyethyl, and $W^3$, $W^4$, $W^5$ and $W^6$ are hydrogen atoms, chlorine atoms, phenyl or alkoxy.

7. The method according to claim 6, wherein at least one of respective $R^2$ and $R^3$, $R^7$ and $R^8$, and $R^{10}$ and $R^{11}$ is carboxyalkyl or sulfoalkyl.

8. The method according to claim 1, wherein the silver halide emulsion contains a dye image providing material which forms a color image, corresponding to the amount of development silver in the emulsion layer, on coupling with an oxidation product of a color developing agent.

* * * * *